US011680374B2

(12) United States Patent
Osler

(10) Patent No.: US 11,680,374 B2
(45) Date of Patent: Jun. 20, 2023

(54) DIRECT FIXATION FASTENER ASSEMBLY FOR TRACK RAIL HAVING MOLDED SUPPORT BLOCK AND METHOD OF MAKING SAME

(71) Applicant: Progress Rail Services Corporation, Albertville, AL (US)

(72) Inventor: Scott David Osler, Southland, NY (US)

(73) Assignee: Progress Rail Services Corporation, Albertville, AL (US)

( * ) Notice: Subject to any disclaimer, the term of this patent is extended or adjusted under 35 U.S.C. 154(b) by 658 days.

(21) Appl. No.: 16/734,049

(22) Filed: Jan. 3, 2020

(65) Prior Publication Data

US 2021/0207329 A1 Jul. 8, 2021

(51) Int. Cl.
*E01B 9/46* (2006.01)
*E01B 1/00* (2006.01)

(52) U.S. Cl.
CPC ..... *E01B 9/46* (2013.01); *E01B 1/004* (2013.01)

(58) Field of Classification Search
CPC ..... E01B 1/004; E01B 9/46
See application file for complete search history.

(56) References Cited

U.S. PATENT DOCUMENTS 1,460,115 A 6/1923 Stent
3,576,293 A 4/1971 Landis
3,945,566 A 3/1976 Bush
3,994,436 A 11/1976 Sonneville
6,488,215 B2 12/2002 Mohr
6,761,322 B1 * 7/2004 Porrill ..... E01B 9/483 238/264
7,156,319 B2 1/2007 Kowalski
9,004,372 B1 4/2015 Alsop et al.

FOREIGN PATENT DOCUMENTS

CN 103174071 1/2015
EP 1721043 4/2012
KR 200337976 * 1/2004 ..... E01B 3/28

OTHER PUBLICATIONS

International Search Report for International Patent Appln. No. PCT/US2020/066603, dated Apr. 14, 2021 (13 pgs).

* cited by examiner

*Primary Examiner* — Robert J McCarry, Jr.
(74) *Attorney, Agent, or Firm* — Brannon Sowers & Cracraft

(57) ABSTRACT

A fastening system for track rail includes a molded support block, and a direct fixation fastener positioned upon an upper side of the molded support block. The direct fixation fastener includes a metallic frame and a non-metallic over-molded jacket. Clamping fasteners of the fastening system are structured to engage with retention elements integrally molded in a concrete matrix material of the molded support block to clamp the direct fixation fastener to the upper side within a range of lateral positions.

18 Claims, 5 Drawing Sheets

DIRECT FIXATION FASTENER ASSEMBLY FOR TRACK RAIL HAVING MOLDED SUPPORT BLOCK AND METHOD OF MAKING SAME

TECHNICAL FIELD

The present disclosure relates generally to direct fixation fastening of track rail, and more particularly to a direct fixation fastener assembly having a molded support block and a direct fixation fastener attached to the molded support block.

BACKGROUND

Rail equipment is used across the world for transportation of persons and all manner of goods and equipment. Rail lines for freight, passenger, or commuter trains are formed by parallel track rails supported upon a concrete or gravel substrate, for example, and will be familiar to most. A variety of different mechanisms are known for positioning, supporting, and fastening the track rails as well as managing loads and vibrations transmitted by way of the rail and fasteners between rail equipment and the underlying substrate. Rail fastening and fixation systems can range from simple plates that attach rails to wooden ties, to highly engineered direct fixation fasteners formed from an assembly of metallic and non-metallic components.

Installation and servicing of track rail can be a relatively labor-intensive process, regardless of the rail fixation strategy used. In the case of new construction, one known technique requires placing, supporting, and jacking track rails and attached fasteners to a desired elevation, then pouring concrete to form a supporting substrate beneath the track rails. Placement of reinforcements, and positioning of the track rail in such instances can require multiple personnel onsite to perform the required activities. For example, after pouring the concrete, it is often necessary to perform additional manual treatment steps to mitigate voids in the concrete.

One known strategy for direct fixation of track rail is set forth in U.S. Pat. No. 10,081,915 to Constantine. Constantine provides a mechanism for coupling a track rail to a substrate having a rail plate and a base plate, with the rail plate surrounding the base plate, and an overmolded jacket encasing both plates.

SUMMARY OF THE INVENTION

In one aspect, a fastening system for track rail includes a molded support block having a lower side with a lower perimetric edge, an upper side with an upper perimetric edge, and a plurality of outer sides each extending between the lower side and the upper side. At least two of the outer sides are oriented obliquely to the upper side so as to form a taper that opens in a direction of the lower side. The molded support block further includes retention elements positioned within bores opening at the upper side. The fastening system further includes a direct fixation fastener positioned upon the upper side and including a metallic frame having an upper rail plate, and a non-metallic overmolded jacket encasing the metallic frame. A clearance extends in lateral directions between the direct fixation fastener and the upper perimetric edge, such that the direct fixation fastener is positionable at a range of lateral positions upon the upper side of the support block. The fastening system further includes a plurality of clamping fasteners structured to engage with the retention elements to clamp the direct fixation fastener to the upper side within the range of lateral positions.

In another aspect, a track rail fastener assembly includes a molded support block having a lower side with a lower perimetric edge, an upper side with an upper perimetric edge, and a plurality of outer sides. The upper side includes a planar mounting face extending to the upper perimetric edge, and each of the plurality of outer sides includes a side face extending from the upper perimetric edge to the lower perimetric edge. The track rail fastener assembly further includes a direct fixation fastener mounted to the molded support block upon the planar mounting face, and including a metallic frame having an upper rail plate, and a non-metallic overmolded jacket encasing the metallic frame.

In still another aspect, a method of making a track rail fastener assembly includes receiving a molded support block removed from a mold and having a lower side, an upper side, and a plurality of outer sides oriented so as to form a taper opening in a direction of the lower side. The method further includes positioning a direct fixation fastener having an overmolded non-metallic jacket encasing a metallic frame upon a planar mounting face of the upper side that extends to an upper perimetric edge of the molded support block. The method further includes engaging clamping fasteners with retention elements molded integrally within a matrix material of the molded support block, and coupling the direct fixation fastener to the molded support block with the clamping fasteners.

DETAILED DESCRIPTION

Figure 1:
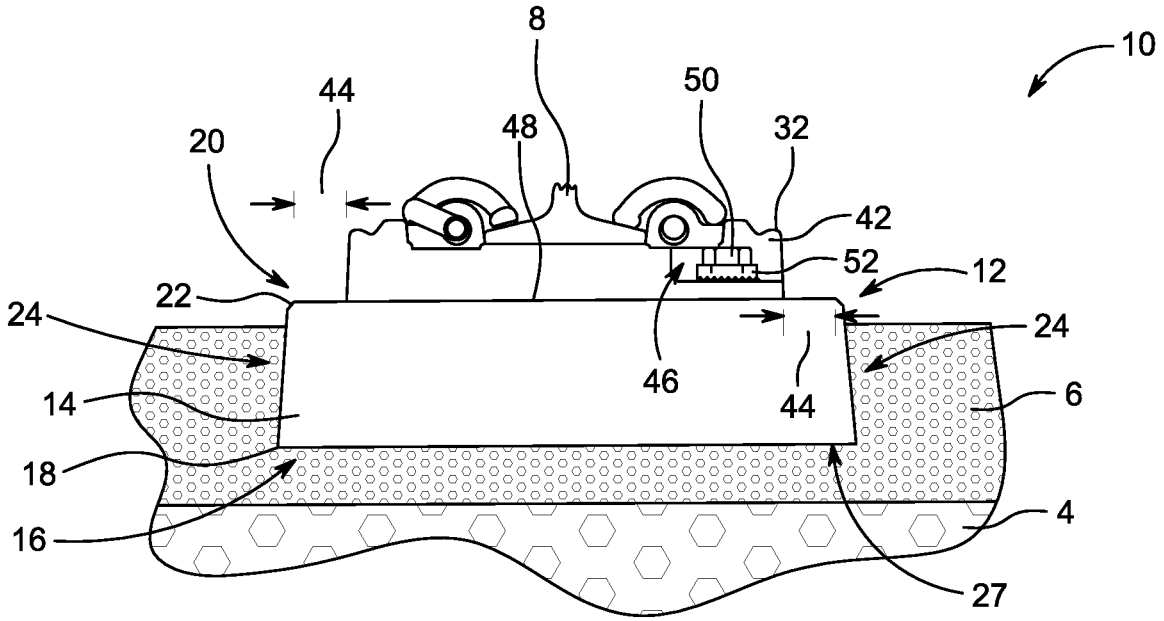
FIG. 1 is a diagrammatic view of a fastening system for track rail, according to one embodiment.

Referring to FIG. 1, there is shown a fastening system 10 for track rail according to one embodiment. Fastening system 10 includes a direct fixation fastener assembly 12, shown positioned within poured and cured concrete 6 upon a prepared deck 4, such as gravel or the like. A track rail 8 is shown fastened to direct fixation fastener assembly 12. In a practical implementation, a plurality of direct fixation fastener assemblies similar to assembly 12 will be positioned at spaced-apart locations along a length of track rail 8, in parallel with another plurality of substantially identical direct fixation fastener assemblies supporting a second track rail. As will be further apparent from the following description, fastening system 10 is contemplated to provide for a less labor-intensive installation of track rails in at least certain applications.

Figure 3:
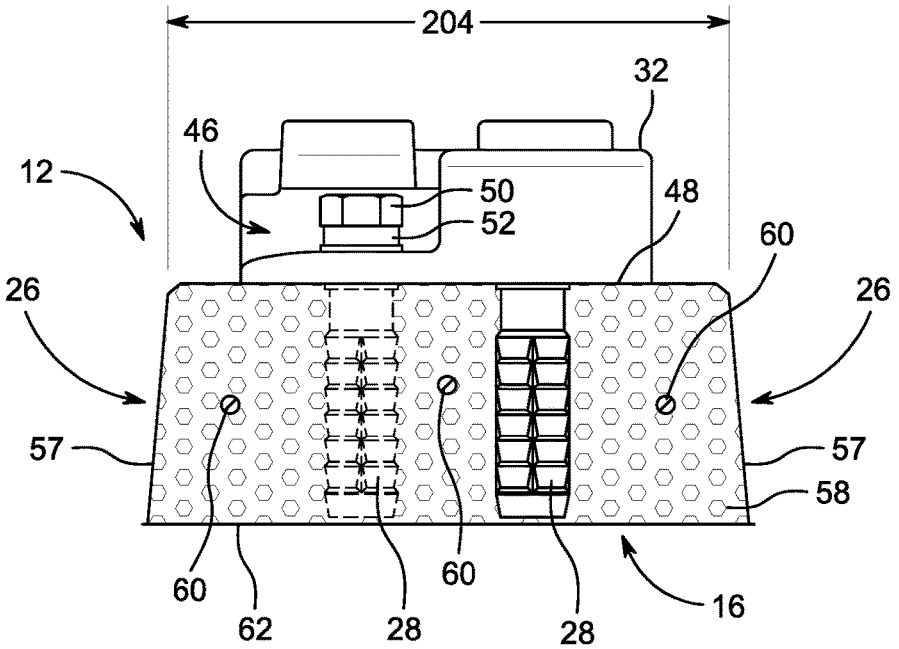
FIG. 3 is another diagrammatic view of the direct fixation fastener assembly as in FIG. 2.

Assembly 12 includes a molded support block 14 having a lower side 16 including a lower perimetric edge 18, an upper side 20 including an upper perimetric edge 22, and a plurality of outer sides 24 each extending between lower side 16 and upper side 20. In the illustration of FIG. 1, assembly 12 is shown as it might appear viewed along a length of track rail 8, and outer sides 24 can be understood as lateral sides. As shown in FIG. 3, discussed hereinafter, the plurality of outer sides can also include a first fore-aft and a second fore-aft outer side each shown with reference numeral 26. At least two of outer sides 24 and 26, and typically opposite ones of outer sides 24 and 26, are oriented obliquely to upper side 20 so as to form a taper 27 that opens in a direction of lower side 16. When poured concrete 6 hardens, taper 27, and optionally another taper formed by outer sides 26, can assist in trapping molded support block 14 within poured concrete 6 to prevent lifting of molded support block 14 out of poured concrete 6. Also in a practical implementation, a plurality of direct fixation fastener assemblies substantially identical to assembly 12 can be positioned at service orientations and locations vertically elevated from deck 4, and poured concrete 6 poured into place and permitted to harden to trap the plurality of direct fixation fastener assemblies therein above deck 4. In some implementations, reinforcements in the nature of rebar may be located within poured concrete 6, and also located within molded support block 14 as further discussed herein. It is unnecessary in at least certain instances, however, to provide reinforcements extending through each of molded support block 14 and poured concrete 6, or within poured concrete 6 itself. Molded support block 14 may be retained within poured concrete 6 solely by virtue of its shape, and potentially an adhesion coating upon outer sides 24 and 26 to assist in adhesion of poured concrete 6 to molded support block 14.

Figure 2:
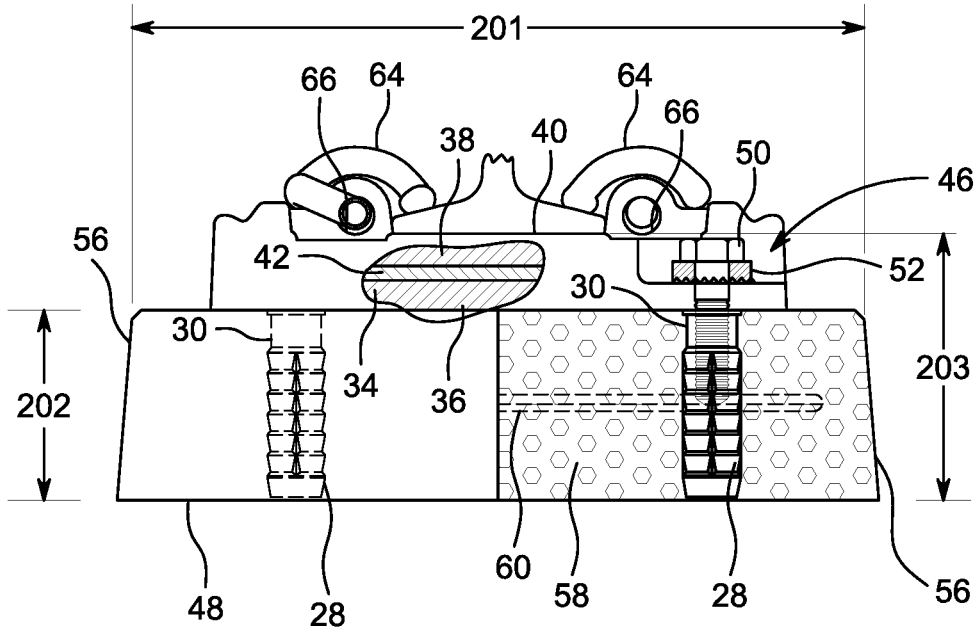
FIG. 2 is a partially sectioned diagrammatic view of a direct fixation fastener assembly, according to one embodiment.

Referring also now to FIGS. 2 and 3, molded support block 14 may further include retention elements 28 positioned within bores 30 opening at upper side 20. Bores 30 may include cast-in features (holes). Retention elements 28 may include internally threaded metallic cylindrical pieces, nuts, or another suitable type of retention element. Alternatively, retention elements 28 could include externally threaded bolts, rods, or other structures cast in place within molded support block 14 with the external threads exposed outside of molded support block 14. Assembly 12 further includes a direct fixation fastener 32 positioned upon upper side 20 and including a metallic frame 34 having an upper rail plate 40 contacted by track rail 8, and a non-metallic overmolded jacket 42 encasing metallic frame 34. Jacket 42 will typically not envelop metallic frame 34, as discussed herein. Metallic frame 34, shown in partial cutaway in FIG. 2, can include a metallic base 36 and an upper piece or "top plate" 38 that includes upper rail plate 40. Metallic frame 34 could be one-piece, or two or more pieces, and the term "frame" is used herein in a general sense to refer collectively to metallic components encased by overmolded jacket 42. Upper rail plate 40 may include a rail contact surface of exposed metallic material of metallic frame 34 directly contacted by track rail 8 in some embodiments. As can also be seen from FIG. 2, overmolded jacket 42 can include overmolded jacket material, such as a suitable elastomeric material, that extends between base piece 36 and upper piece 38. In an implementation, the jacket material may extend entirely between base piece 36 and upper piece 38, such that base piece 36 and upper piece 38 are electrically and physically isolated from one another. Portions of metallic frame 34 contacting molded support block 14 may not be encased by overmolded jacket 42.

Direct fixation fastener 32 may further include rail clips 64 installed within rail clip bores 66 formed in direct fixation fastener 32, such as in upper piece or top plate 38, and positioned upon opposite lateral sides of rail plate 40 to attach track rail 8 to direct fixation fastener 32 in a generally known manner. Upper side 20 of molded support block 14 further includes a planar mounting face 48 extending to upper perimetric edge 22. A clearance 44 extends in lateral directions between direct fixation fastener 32 and upper perimetric edge 22. Direct fixation fastener 32 is positionable at a range of lateral positions upon upper side 20 of molded support block 14. Clearance 44 may also extend in fore and aft directions between direct fixation fastener 32 and upper perimetric edge 22.

Fastening system 10, including assembly 12, further includes a plurality of clamping fasteners 46 structured to engage with retention elements 28 to clamp direct fixation fastener 32 to upper side 20 within the range of lateral positions. Each of clamping fasteners 46 may include a clamping bolt 50 extending through metallic frame 34 and engaged with one of retention elements 28, and a lateral positioner 52 positioned about clamping bolt 50 and adjustable among a plurality of lateral positions relative to metallic frame 34 to vary the lateral position of direct fixation fastener 32 upon planar mounting face 48. Molded support block 14 may also include a planar base face 62 oriented parallel to planar mounting face 48. Each of upper perimetric edge 22 and lower perimetric edge 18 may have a rounded profile transitioning between adjoining ones of planar mounting face 48 or planar base face 62, and one of a plurality of planar side faces 56 and 57 formed by the respective outer sides 24 and 26 and extending from upper perimetric edge 22 to lower perimetric edge 18.

Figure 4:
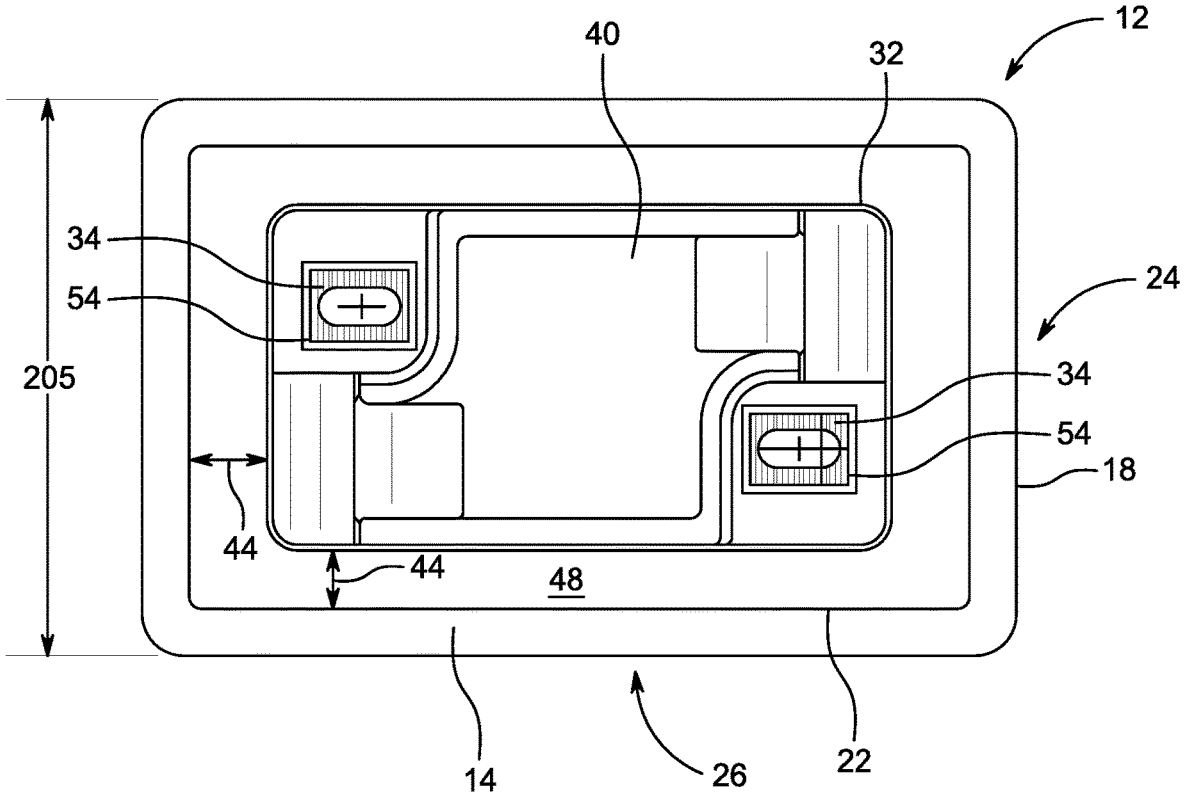
FIG. 4 is a top elevational view of the direct fixation fastener assembly of FIGS. 2 and 3.

As viewed in FIG. 1, it will be appreciated that molded support block 14 has a trapezoidal fore-aft profile, and from FIG. 3 it will be appreciated that molded support block 14 also has a trapezoidal lateral profile, although the present disclosure is not thereby limited. Referring also now to FIG. 4, there can be seen a generally rectangular footprint formed by lower perimetric edge 18, and by lower side 16. FIG. 4 also illustrates a rectangular shape formed by upper perimetric edge 22, and a rectangular shape formed by direct fixation fastener 32. In projection, upper perimetric edge 22 is centered within the rectangular footprint formed by lower perimetric edge 18. Direct fixation fastener 32 may be centered within the rectangular shape formed by upper perimetric edge 22. In other embodiments, one or both of upper perimetric edge 22 and lower perimetric edge 18 could be oval shaped, or still otherwise different from the illustrated embodiment. Side faces 56 and 57 could be rounded rather than planar, and/or could form one continuous rounded face that extends from lower perimetric edge 18 to lower perimetric edge 22 and having an oval shape.

Also shown in FIG. 4 are features of direct fixation fastener 32 as it might appear with clamping fasteners 46 and rail clips 64 removed. Metallic frame 34 may also include exposed metallic features cooperating with lateral positioners 52. In the illustrated embodiment a plurality of teeth 54 running, for example, in fore-aft directions are structured to cooperate with complementary teeth formed on lateral positioners 52. Clamping bolts 50 may extend through direct fixation fastener 32, and direct fixation fastener 32 may be shifted laterally, left or right in the illustration of FIG. 4, to set a desired rail gauge for instance, based on positions of lateral positioners 52 relative to teeth 54. In other embodiments a different lateral positioning strategy might be used. For example, direct fixation fastener 32 could be equipped with eccentrics that include an eccentrically located central bore structured for positioning about one of clamping bolts 50, and rotatable about the respective clamping bolt 50 to adjust a lateral position of metallic frame 34 and thus adjust a lateral position of direct fixation fastener 32 upon molded support block 14. Designs employing an eccentric could also provide some measure of fore-aft or rotational adjustment of a direct fixation fastener in a direct fixation fastener assembly according to the present disclosure.

Figure 5:
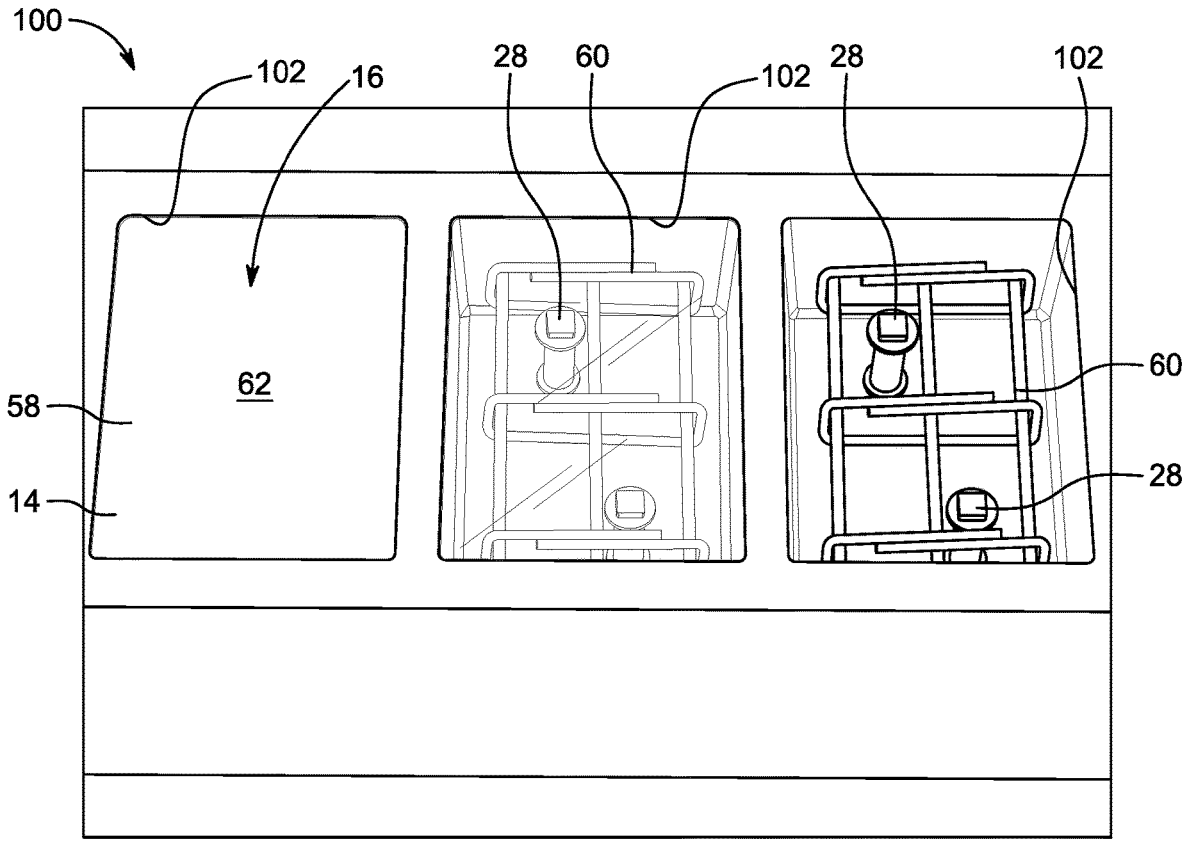
FIG. 5 is a diagrammatic view of a molding apparatus at one stage in making direct fixation fastener assemblies, according to one embodiment.

Referring also now to FIG. 5, there is shown a molding apparatus 100 as it might appear at one stage of making a plurality of molded support blocks for a plurality of direct fixation fastener assemblies in accordance with the present disclosure. Molding apparatus 100 includes a plurality of molding voids 102. In FIG. 5, reinforcements 60 and retention elements 28 are shown positioned within two of molding voids 102 as they might appear prior to pouring a material in a liquid form into molding voids 102 for forming molded support blocks. In a practical implementation, molded support blocks according to the present disclosure may include a concrete matrix material 58 that is cured into a solid form and integrally molds with the components previously positioned within molding voids 102, including retention elements 28 and reinforcements 60. The tapered shape, and trapezoidal profiles of molded support block 14, can assist not only in retention of molded support block 14 within poured concrete as discussed in reference to FIG. 1, but can also assist in removal from molding apparatus 100. Other tapered shapes, such as an oval tapered shape as discussed above can provide analogous functionality.

Figure 6:
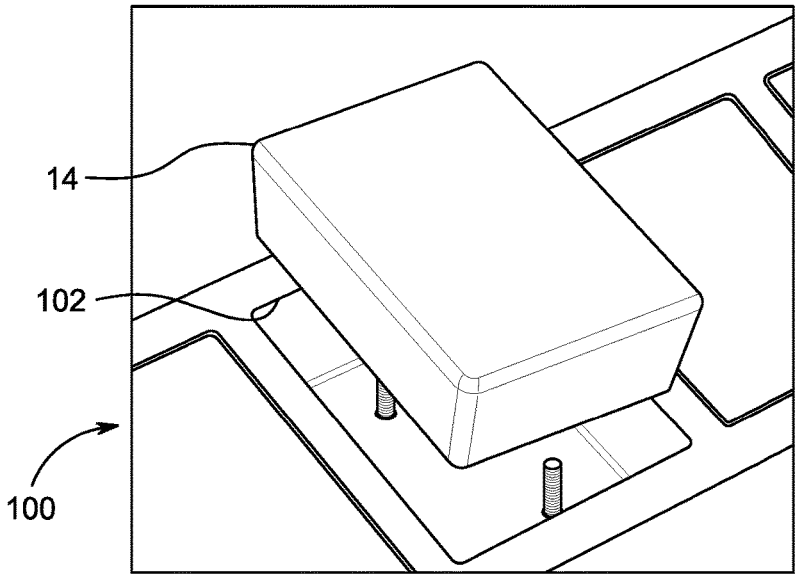
FIG. 6 is a diagrammatic view of the molding apparatus of FIG. 5 at another stage.
Figure 7:
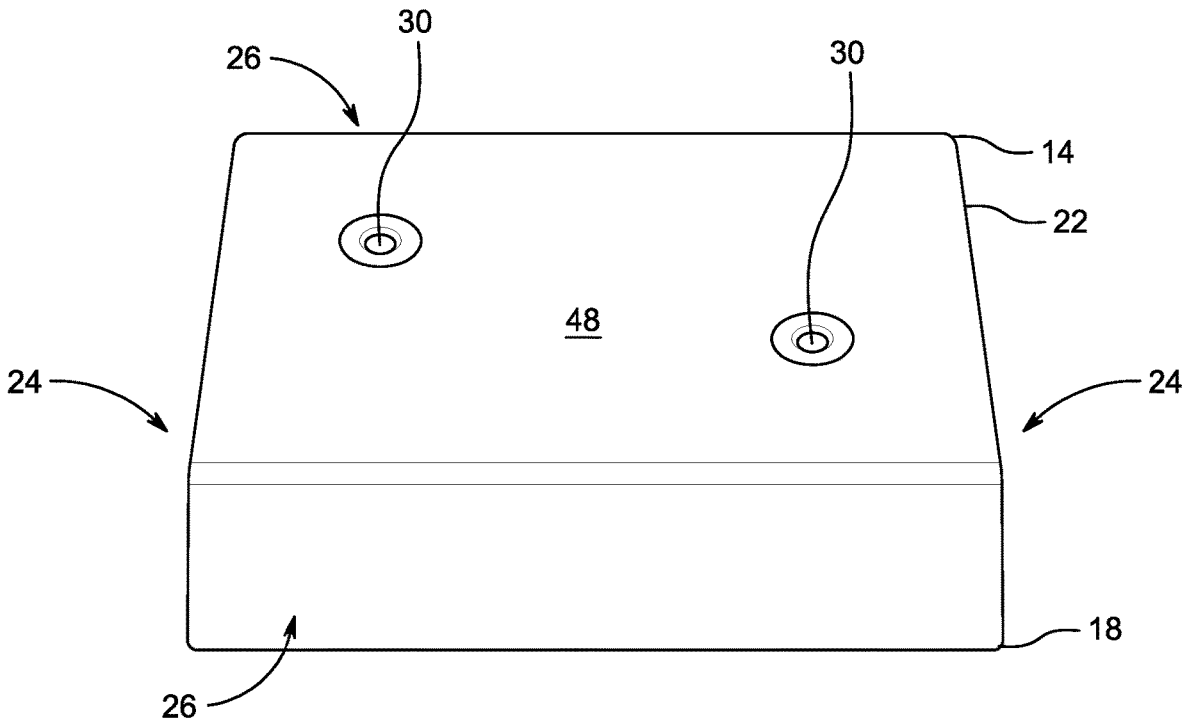
FIG. 7 is a diagrammatic view of a support block for a direct fixation fastener assembly, according to one embodiment.
Figure 8:
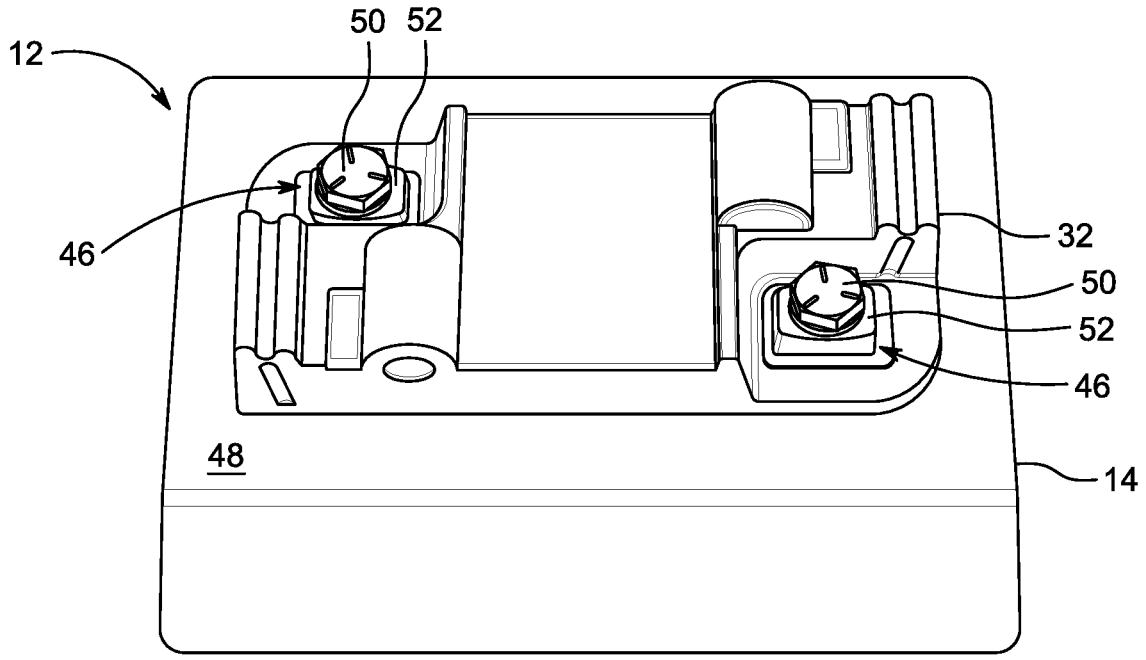
FIG. 8 is a diagrammatic view of a direct fixation fastener assembly, according to one embodiment.

Reinforcements 60 can include conventional rebar, which in the illustrated case is in the form of a rebar cage having rebar extending along several sides and coupled together to form a cage-like three-dimensional enclosure situated entirely within molded support block 14. Other than conventional rebar, other reinforcement materials such as composites, fabrics, or still others could be used. Once concrete matrix material 58 has cured, molded support block 14 can be removed from molding apparatus 100 approximately as shown in FIG. 6. Referring also now to FIG. 7, there is shown a view of molded support block 14 as it might appear removed from molding apparatus 100 and prior to attaching direct fixation fastener 32. It can be seen from FIG. 7 that the disclosed molding process provides a smooth and finished exterior surface texture to molded support block 14, with no post-molding processing typically being required. In some instances, a direct fixation fastener can be coupled to, and clamped to, a molded support block at the same location where the molded support block is made. In other instances, molded support blocks removed from a mold can be transported to another location, such as to a jobsite, and received by personnel at the jobsite for positioning and attachment of a direct fixation fastener thereon. Referring to FIG. 8, there is shown assembly 12 as it might appear after attaching direct fixation fastener 32 upon planar mounting face 48 of molded support block 14. Direct fixation fastener 32 may also be coupled to molded support block 14, but not clamped to molded support block 14, until such time as a desired lateral position and coupling with a track rail has been determined. While it is contemplated that a concrete matrix material including, for example, a mixture of an aggregate and a cement, is a practical implementation strategy, in other embodiments a different matrix material such as a flowable, curable non-metallic material, a composite material, or still another might be used.

Referring back to FIGS. 1-4, it can be noted that molded support block 14 extends proud of poured concrete 6, such that planar mounting face 48 is elevated above a surface of poured concrete 6. It can also be seen from FIGS. 2-4 that certain example dimensional attributes of assembly 12 are identified, although the present disclosure is not limited to any specific dimensions or proportions. In FIG. 2, a lateral width dimension 201 is shown and defined by upper perimetric edge 22. A height dimension of molded support block 14 is shown at 202. Height dimension 202 may be about 25-27% of lateral width dimension 201. FIG. 3, showing a lateral side view, includes a fore-aft width dimension 204. Height dimension 202 may be about 42-44% of fore-aft width dimension 204. FIG. 4 also illustrates a fore-aft width dimension 205 defined by lower perimetric edge 18. Width dimension 205 will generally be greater than width dimension 204, and height dimension 202 may be about 36-38% of width dimension 205. Another height dimension, between planar base face 62 and upper rail plate 40 is shown at 203. Height dimension 202 might be about 71-73% of height dimension 203. A base lateral width dimension, normal to dimension 205, and defined by lower perimetric edge 18, might be about four times height dimension 202. In a specific non-limiting example height dimension 202 might be about 5 inches. Assembly 12 can be structured to fasten one track rail or multiple track rails, and direct fixation fastener 32 can therefore have a range of sizes to accommodate one versus multiple track rails, and potentially varying rail gauges. A lateral width of direct fixation fastener 32 might range from about 14 inches to about 70 inches in some embodiments, or potentially larger still, and can include multiple interfaces for fastening multiple track rails. A size, including at least a lateral width, of molded support block 14 can vary consistent with applications to different sizes and configurations of direct fixation fasteners. As used herein, the term "about" may be understood to mean generally or approximately in the relevant technical field, for example, using conventional rounding. Accordingly, "about 50 percent" may mean from 45 percent to 54 percent, within measurement error. In other instances the term "about" could be understood to have a different or broader meaning than conventional rounding.

INDUSTRIAL APPLICABILITY

Referring to the drawings generally, in view of the present description it will be appreciated that assembly 12 can be constructed prior to installation. This capability eliminates any need to reinforce poured concrete around a support block in a track rail fastening system as the support block already has any needed reinforcements, such as rebar, molded integrally therein. This capability is also considered to typically remove the need for personnel to create forms around fastener systems or assemblies. In some instances, fastener system 10 and other fastener systems contemplated herein can be applied in rail tunnel applications. Eliminating or reducing the need to create forms will generally enable service personnel and contractors to simply fill the floor of the rail tunnel with concrete to an appropriate level. Based on the use of a molding technique to form molded support blocks according to the present disclosure, exposed surfaces of concrete matrix material can be provided with a factory finish contemplated to reduce or eliminate any need for mitigating voids between support block 14 and surrounding poured concrete. In addition to reducing labor efforts in rail construction, a reduced need for rebar or form material, and reduced construction time, can be expected.

Figure 9:
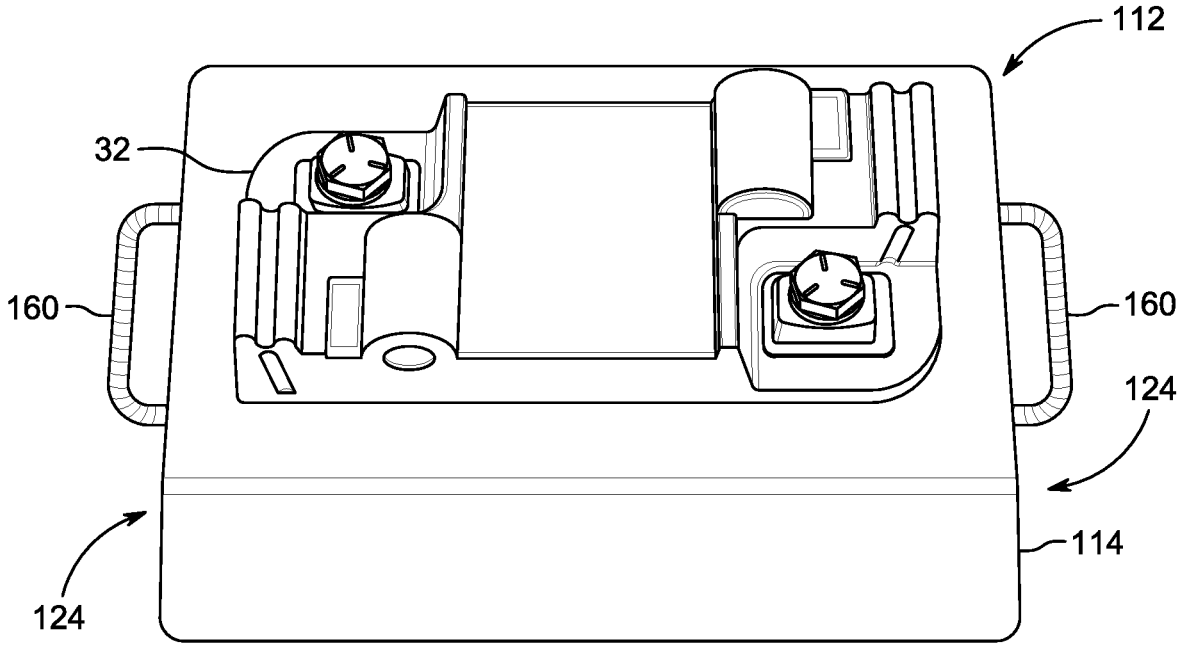
FIG. 9 is a diagrammatic view of a direct fixation fastener assembly, according to another embodiment.

Embodiments are nevertheless contemplated where reinforcements between a poured concrete base and a support block in a fastener assembly are provided. Referring to FIG. 9, there is shown a diagrammatic view of a direct fixation fastener assembly 112 including a direct fixation fastener 32, and a support block 114. Direct fixation fastener 32 as in FIG. 9 may be substantially identical to other embodiments discussed herein. Molded support block 114 can differ, however, in that rebar 160 is provided that projects from concrete matrix material of molded support block 114. In the embodiment shown in FIG. 9, molded support block 114 includes lateral outer sides 124, and rebar reinforcements 160 project from outer sides 124. In other embodiments a different reinforcement configuration or reinforcement projection location, might be used.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed:

1. A fastening system for track rail comprising:

a molded support block including a lower side having a base face extending to a lower perimetric edge, an upper side having an upper perimetric edge, and a plurality of outer sides each extending between the lower side and the upper side;

at least two of the outer sides each including a respective planar side face extending continuously from the upper perimetric edge to the lower perimetric edge, and being oriented obliquely to the upper side so as to form a taper that opens in a direction of the lower side;

the molded support block further including retention elements positioned within bores opening at the upper side;

a direct fixation fastener positioned upon the upper side and including a metallic frame having an upper rail plate, and a non-metallic overmolded jacket encasing the metallic frame;

a clearance extends in lateral directions from the direct fixation fastener to the upper perimetric edge, such that the direct fixation fastener is positionable at a range of lateral positions upon the upper side of the support block;

a plurality of clamping fasteners structured to engage with the retention elements to clamp the direct fixation fastener to the upper side within the range of lateral positions; and reinforcements situated entirely within the molded support block such that the plurality of outer sides are entirely unobstructed from the upper perimetric edge to the lower perimetric edge.

2. The fastening system of claim 1 wherein the upper side includes a planar mounting face extending to the upper perimetric edge, and the clearance extends in fore and aft directions between the direct fixation fastener and the upper perimetric edge.

3. The fastening system of claim 2 wherein the clamping fasteners each include a clamping bolt engaged with one of the retention elements, and a lateral positioner adjustable among a plurality of lateral positions relative to the metallic frame to vary the lateral position of the direct fixation fastener upon the planar mounting face.

4. The fastening system of claim 2 wherein the lower perimetric edge forms a rectangular footprint, and the upper perimetric edge is rectangular in shape and, in projection, centered within the rectangular footprint.

5. The fastening system of claim 4 wherein the plurality of outer sides each include a planar side face extending from the upper perimetric edge to the lower perimetric edge.

6. The fastening system of claim 1 wherein the molded support block has a trapezoidal fore-aft profile, and a trapezoidal lateral profile.

7. The fastening system of claim 1 wherein the molded support block includes a concrete matrix material, and the reinforcements are molded integrally within the concrete matrix material.

8. A track rail fastener assembly comprising:

a molded support block including a lower side having a base face extending to a lower perimetric edge, an upper side having an upper perimetric edge, and a plurality of outer sides;

the upper side including a planar mounting face extending to the upper perimetric edge, and each of the plurality of outer sides including a planar side face extending continuously from the upper perimetric edge to the lower perimetric edge;

the lower perimetric edge forms a rectangular footprint, and the molded support block has a trapezoidal fore-aft profile, and a trapezoidal lateral profile;

the molded support block defining a fore-aft width dimension of the upper side, and a height dimension between the lower side and the upper side that is from about 42% to about 44% of the fore-aft width dimension;

reinforcements situated entirely within the molded support block such that the plurality of outer sides are entirely unobstructed from the upper perimetric edge to the lower perimetric edge; and a direct fixation fastener mounted to the molded support block upon the planar mounting face, and including a metallic frame having an upper rail plate, and a non-metallic overmolded jacket encasing the metallic frame and extending between the metallic frame and the planar mounting face.

9. The assembly of claim 8 wherein the molded support block includes a concrete matrix material, and the reinforcements are molded integrally within the concrete matrix material.

10. The assembly of claim 9 wherein the reinforcements include a rebar reinforcement cage.

11. The assembly of claim 9 wherein the molded support block includes retention elements molded integrally within the concrete matrix material, and the direct fixation fastener further includes clamping fasteners extending through the metallic frame and engaged with the retention elements.

12. The assembly of claim 11 wherein the clamping fasteners each include a clamping bolt engaged with one of the retention elements, and a lateral positioner adjustable among a plurality of lateral positions relative to the metallic frame to vary a lateral position of the direct fixation fastener upon the planar mounting face.

13. The assembly of claim 8 wherein the lower side includes a planar base face oriented parallel to the planar mounting face, and each of the upper perimetric edge and the lower perimetric edge has a rounded profile transitioning between an adjoining one of the planar mounting face or the planar base face, and one of the planar side faces.

14. A method of making a track rail fastener assembly comprising:

receiving a molded support block removed from a mold and having a lower side including a base face extending to a lower perimetric edge, an upper side including a planar mounting face extending to an upper perimetric edge, a plurality of outer sides oriented so as to form a taper opening in a direction of the lower side, and reinforcements situated entirely within the molded support block such that the plurality of outer sides are entirely unobstructed from the upper perimetric edge to the lower perimetric edge;

positioning a direct fixation fastener having an overmolded non-metallic jacket encasing a metallic frame upon the planar mounting face;

engaging clamping fasteners with retention elements molded integrally within a matrix material of the molded support block; and coupling the direct fixation fastener to the molded support block with the clamping fasteners.

15. The method of claim 14 further comprising positioning the reinforcements within the mold, and molding the reinforcements integrally within a concrete matrix material of the molded support block.

16. The method of claim 15 wherein the engagement of the clamping fasteners with the retention elements further includes passing clamping bolts through the metallic frame of the direct fixation fastener, and further comprising placing lateral positioning elements about the clamping bolts and in contact with the metallic frame.

17. The method of claim 14 further comprising installing rail clips within rail clip bores formed in the direct fixation fastener and positioned upon opposite lateral sides of a rail plate of the metallic frame.

18. The method of claim 14 wherein the receiving of a molded support block further includes receiving a molded support block having a trapezoidal fore-aft profile and a trapezoidal lateral profile.

* * * * *